US006317969B1

(12) United States Patent
Funaya et al.

(10) Patent No.: US 6,317,969 B1
(45) Date of Patent: Nov. 20, 2001

(54) SLIDER-PULL-ASSEMBLING UNIT

(75) Inventors: Kazuhiro Funaya; Yukio Maruyama, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/533,623

(22) Filed: Mar. 22, 2000

(30) Foreign Application Priority Data

Mar. 25, 1999 (JP) ..... 11-080821

(51) Int. Cl.[7] ..... B29D 5/00

(52) U.S. Cl. ..... 29/766; 29/408; 29/33.2; 29/712

(58) Field of Search ..... 29/766, 408, 33.2, 29/709, 712

(56) References Cited

U.S. PATENT DOCUMENTS

Re. 31,751 * 12/1984 Hakoi .
5,067,221 * 11/1991 Oyama ..... 29/766
5,174,017 * 12/1992 Hatagashi ..... 29/766
5,426,840 * 6/1995 Funaya ..... 29/766

* cited by examiner

*Primary Examiner*—P. W. Echols
(74) *Attorney, Agent, or Firm*—Finnegan, Henderson, Farabow, Garrett & Dunner, L.L.P.

(57) ABSTRACT

In a pull-assembling unit for automatically assembling a pull onto a slider body of a slide fastener, a slider transporting means includes a slider-body-transportation plate member having rectangular notch portions spaced at intervals of plural assembling sections along a top end edge thereof, each for accommodating the slider body. The slider-body-transportation plate member is adapted to be actuated in the slider-transportation path so as to draw a rectangular trajectory in a vertical plane. An actuation upper limit position of a top end of the rectangular notch portion is set to be above a slider-body-placing surface of the slider-transportation path and an actuation lower limit position of the top end of the notch portion is set to be at a retreat position below the slider-body-placing surface. Therefore, the slider-pull-assembling unit has a simple structure and is capable of assembling a pull onto a slider body accurately and securely at a high speed.

2 Claims, 8 Drawing Sheets

SLIDER-PULL-ASSEMBLING UNIT

BACKGROUND OF THE INVENTION

1. Field of the Invention

The present invention relates to a slider-pull-assembling unit for automatically assembling a pull onto a slider for opening/closing a slide fastener. More particularly, it relates to a slider-pull-assembling unit which enables effective transportation of sliders and assembly of a pull thereto in accordance with assembling steps.

2. Description of the Related Art

Conventionally, a unit for automatically assembling a pull onto a slider body by inserting an annular connecting portion of the pull into an opening formed in part of a pull-attachment lug of the slider body and then crimping the pull-attachment lug to close the opening has been already reduced to practice. Such a unit has been disclosed in, for example, Japanese Patent Publication No. 1-25563, Japanese Utility Model Publication No. 5-29603, Japanese Patent Publication No. 7-79726.

In the slider-pull-assembling units disclosed in the Japanese Patent Publication No. 1-25563 and Japanese Patent Publication No. 7-79726, a slider-body-transportation means and a pull-supply means are the same in principle. In these units, a slider body supplied from a slider-body-supply path is carried forward by a slider-body pusher. In front of the slider-body-supply path, a pull supplied from a pull-supply path waits in such a state that its annular connecting portion faces a position where an open end of a pull-attachment lug of the slider body passes. When the slider body is pushed and fed by the slider body pusher and the open end of the pull-attachment lug is inserted into the annular connecting portion of the pull, the pull-attachment lug is crimped by a lug-crimping apparatus so as to close the open end. Then, the pull is further pushed forward, thus the assembling of the pull is completed.

The aforementioned Japanese Patent Publication No. 1-25563 and Japanese Patent Publication No. 7-79726 are different from each other in that the lug-crimping apparatus of the former is comprised of a punch and a die which are driven under control while that of the latter is comprised of a punch roller which rotates in one direction and a supporting base.

On the other hand, in the slider-pull-assembling unit disclosed in the aforementioned Japanese Utility Model Publication No. 5-29603, equally spaced slider-accommodating portions are formed in an outer peripheral surface of a rotation disk that rotates intermittently. A pull is supplied obliquely from above to one of the slider-accommodating portions through a supply chute, and the supplied pull is held by a pull-holding member that advances/moves back horizontally with respect to a bottom end of the supply chute. At this time, the pull-holding member keeps an annular connecting portion of the pull facing the slider-accommodating portion. In this state, the pull-holding member moves back so as to insert the annular connecting portion onto an open end of a pull-attachment lug of the slider body. After that, a rear holding piece of the pull-holding member is moved back while a front holding piece thereof is lowered so as to crimp the pull-attachment lug, thereby closing the open end of the pull-attachment lug.

However, according to the pull-assembling unit disclosed in the aforementioned Japanese Patent Publication No. 1-25563, the slider-body pusher, which pushes and carries a slider body from the slider-supply chute to a crimping position of the pull-attachment lug's open end via the pull-supply chute, keeps its extended state until the pull-attachment lug's open end is crimped and closed at the open end crimping position, and after the crimping is completed, the slider body pusher starts moving back. Therefore, advancement and moving back are performed for a single assembling. As a result, it takes a long time to complete an assembly of the pull onto the slider body, so that the assembly cannot be carried out at a high speed. Further, in the slider-pull-assembling unit disclosed in the aforementioned Japanese Patent Publication No. 7-79726, because the slider-body pusher advances and moves back for every assembly of the pull onto the slider body, it has the same problem as described above.

Further, there is a problem common to the pull-assembling units of these patent publications. While the open end of the pull-attachment lug of the slider body is inserted into the annular connecting portion of the pull, and then the slider body is pushed and carried to a crimping position of the crimping unit at a subsequent process, the open end of the pull-attachment lug is kept open. Moreover, the slider body is forcibly pushed forward and carried with the pull held by the supply chute in an elastic state being hooked on the open end of the pull-attachment lug of the slider body. Thus, when the pull is extracted from the pull-supply chute resisting the elasticity, a free end of the pull tends to jump up so that the pull is easy to slip out of the open end of the pull-attachment lug. This slip-out is more likely to occur as the unit processing speed is accelerated.

In the pull-assembling unit disclosed in the aforementioned Japanese Utility Model Publication No. 5-29603, not only a structure of the holding member is complicated, but also it is difficult to keep an accurate timing between the rotation disk and the holding member and an accurate timing of complicated actuation of the holding member itself for a long time. Further, it takes considerably a long time for maintenance and control of these components.

SUMMARY OF THE INVENTION

Accordingly, the present invention has been accomplished to solve those problems, and therefore, an object of the invention is to provide a slider-pull-assembling unit having a simple structure and capable of assembling a pull onto a slider body accurately and securely at a high speed.

To achieve the above object, according to a first aspect of the present invention, there is provided a slider-pull-assembling unit having plural assembling sections for automatically assembling a pull onto a slider body of a slider for opening/closing a slide fastener, comprising: a slider-transportation path for transporting the slider bodies to the plural assembling sections in succession; a slider-body-supply path connected to the slider-transportation path; a pull-supply path disposed halfway of the slider-transportation path for supplying the pull to the slider-transportation path; and a slider transporting means for transporting the slider body along the slider-transportation path intermittently, wherein the slider transporting means includes a slider-body-transportation plate member having rectangular notch portions spaced at intervals of the plural assembling sections along a top end edge, each for accommodating the slider body, the slider-body-transportation plate member being adapted to be actuated in the slider-transportation path so as to draw a rectangular trajectory in a vertical plane, and an actuation upper limit position of a top end of the rectangular notch portion is set to be above a slider-body-placing surface of the slider-transportation path and an actuation lower limit position of the top end of the notch portion is set to be at a retreat position below the slider-body-placing surface.

When the slider-body-transportation plate member stands by at a position below the slider-transportation path, the slider bodies sent to the plural assembling sections spaced at equal pitches along the slider-transportation path, on which the pulls are installed, wait for a next transportation on the slider-transportation path. Then, the slider-body-transportation plate member ascends to accommodate the respective slider bodies waiting on the slider-transportation path in the respective notch portions.

After this accommodation is finished, the slider-body-transportation plate member advances only by a single pitch in a transportation direction in a vertical plane of the slider-transportation path so as to transport the slider bodies accommodated in the respective notch portions to the assembling sections of the next step all at once. After this transportation is completed, the slider-body-transportation plate member descends below the slider-transportation path, and at the same time, the assembling operations at the respective assembling sections are started. Before this assembly is finished, the slider-body-transportation plate member is moved back to its original standby position.

By repeating this operation, the respective assembling works at the plural assembling sections are carried out at the same time. Further, because when the assembling works are completed, the plural slider bodies are carried to each next step, effective assembly and transportation can be achieved thereby realizing high-speed manufacturing.

According to a second aspect of the present invention, there is provided a slider-pull-assembling unit, wherein the pull-supply path is disposed obliquely at a predetermined angle with respect to the slider-transportation path, extending from above a rear portion thereof, and a crimping section for a pull-attachment lug of the slider body is disposed in front of and near a confluent position of the pull-supply path and the slider-transportation path. The pull supplied from the pull-supply chute temporarily held by the pull-supply chute at the bottom end thereof.

According to this aspect of the present invention, each of the slider bodies is transported from the back of the pull-supply path and its pull-attachment lug is inserted into a hole of an annular connecting portion of each of the pulls. Then, the slider body is stopped there. Since the crimping section for the slider pull-attachment lug is disposed in front of and near the confluent position of the slider-transportation path and the pull-supply path, the pull-attachment lug is crimped from above at the aforementioned stop position of the slider body where the pull is held temporarily, thus closing an open end of the pull-attachment lug. Therefore, at the time of the crimping, the pull is kept stationary. Thus, different from the aforementioned conventional case in which the slider body is transported with the pull hooked on its pull-attachment lug and then the pull-attachment lug is crimped, the pull never slips out of the pull-attachment lug, so that it can be assembled onto the slider body securely.

DESCRIPTION OF THE EMBODIMENTS

Figure 1:
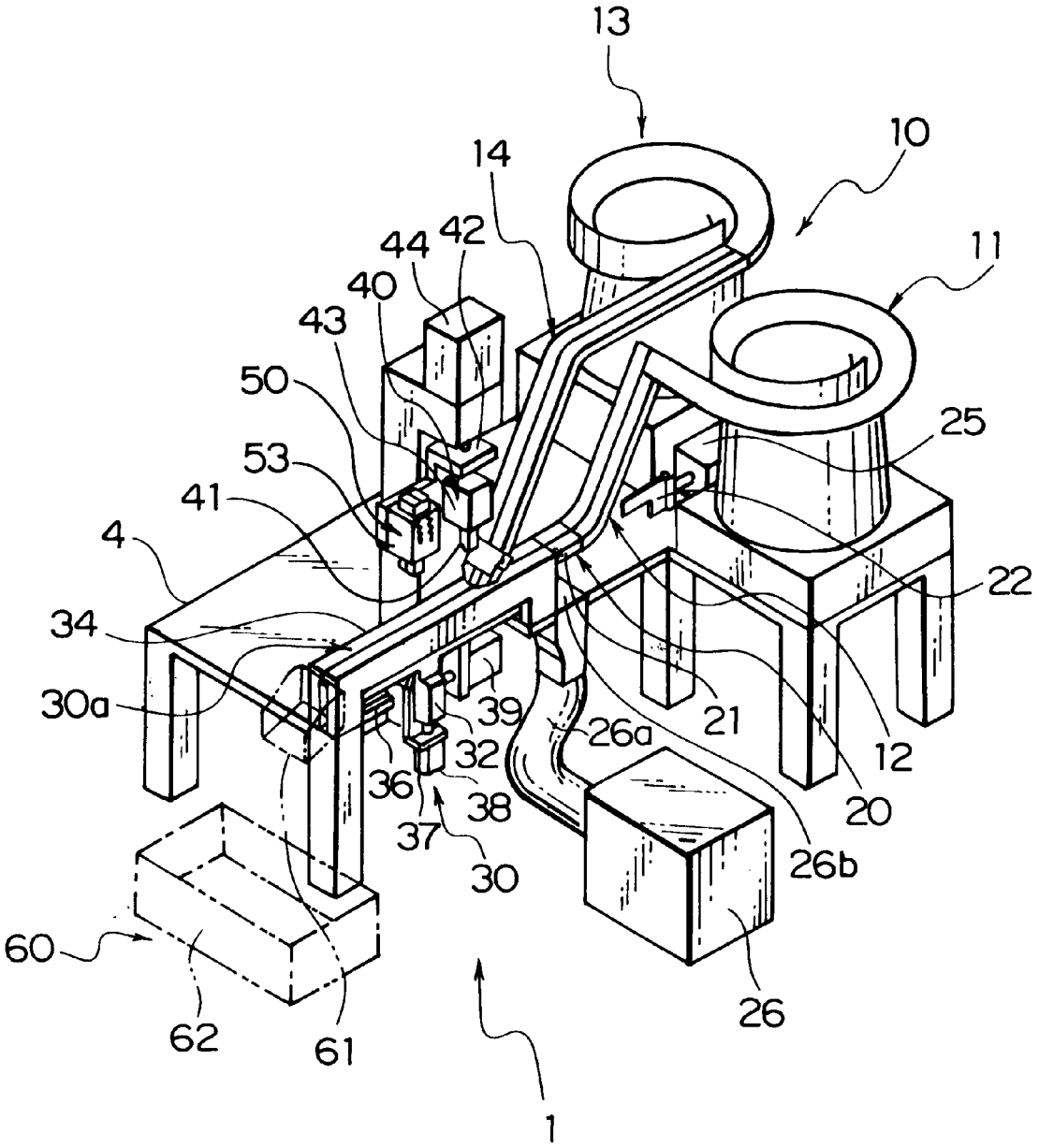
FIG. 1 is a perspective view schematically showing a slider-pull-assembling unit of the present invention.

Hereinafter, embodiments of the present invention will be described in detail with reference to the accompanying drawings. FIG. 1 schematically shows an entire structure of a slider-pull-assembling unit, which is a typical embodiment of the present invention.

In the slider-pull-assembling unit 1 of the embodiment shown here, mainly a slider-body-and-pull-supply section 10, a burr-removing section 20 for a slider body 2, a slider-transportation section 30, a slider-body-pull-attachment-lug crimping section 40, a slider-inspecting section 50, a slider-discharge section 60 are arranged in succession at a predetermined pitch.

Figure 2:
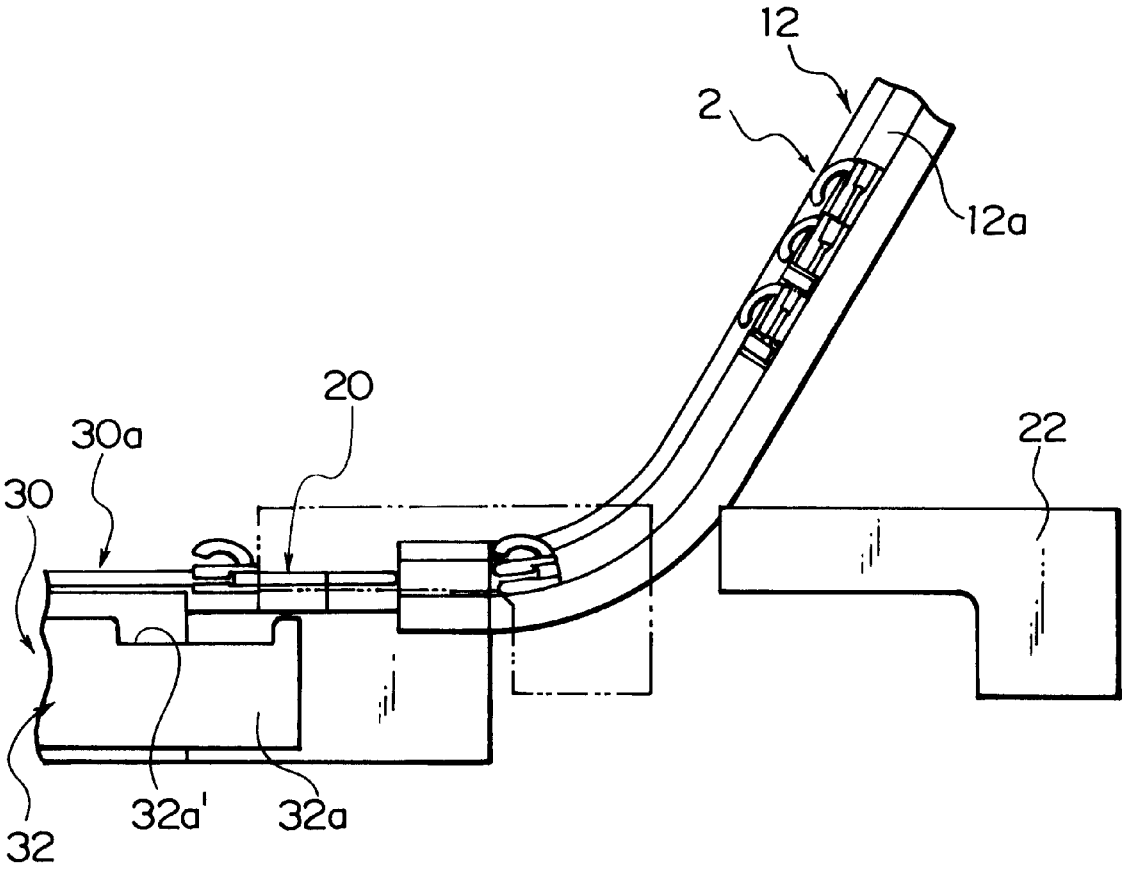
FIG. 2 is a longitudinal sectional view schematically showing a structure of a slider-body-supply chute and a burr-removing section.

The slider-body-and-pull-supply section 10 comprises a slider-body feeder 11, a slider-body chute 12 extending from the slider-body feeder 11 to the burr-removing section 20, a pull feeder 13, and a pull chute 14 extending from the pull feeder 13 to the slider-transportation section 30. The slider-body chute 12 is linearly disposed so as to obliquely intersect the slider-transportation section 30*a* as shown in FIG. 2, and has an end portion curved such that a supply port of the slider-body-supply path 12*a* is parallel to a transportation direction of a slider. The supply port is joined to the slider-transportation path 30*a* at the burr-removing section 20 which will be described later.

Figure 5:
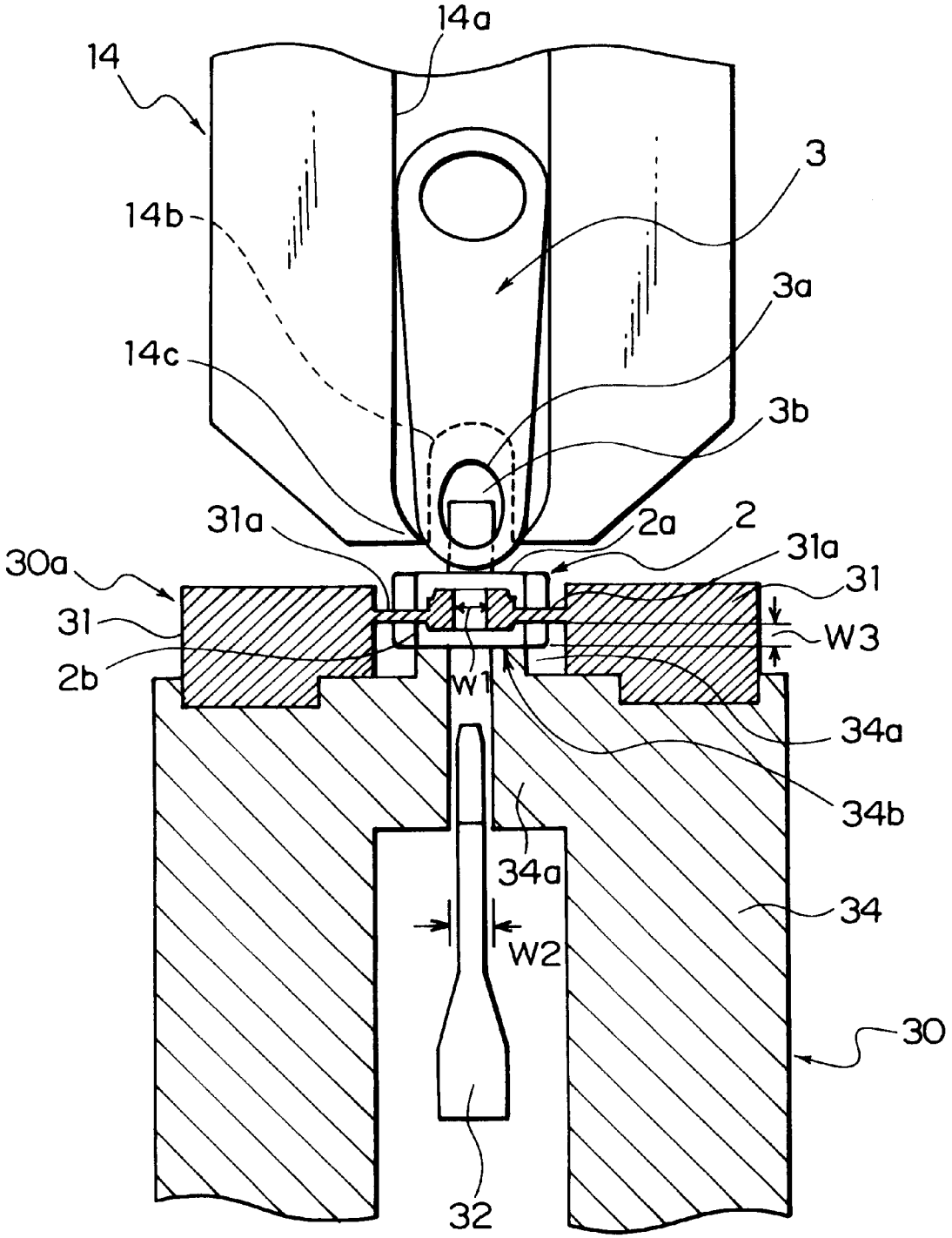
FIG. 5 is a sectional view showing an assembling mechanism for assembling a pull onto a pull assembling portion of the slider body.

On the other hand, in an end portion of the pull chute 14, as shown in FIG. 5, a terminal end of the pull-supply path 14*a* is cut out in an inverted U shape so as to form a notch portion 14*b*, and right and left pawl portions 14*c* are protruded for holding a front end portion of an annular connecting portion 3*a* of a pull 3 from the right and left sides on the supply path. When the front end of the pull 3 is held by the pawl portions 14*c*, a hole 3*b* of the annular connecting portion 3*a* of the pull 3 communicates with the U-shaped notch portion 14*b* of the pull-supply path 14*a*.

Further, as shown in FIGS. 6 to 9, a holding plate 15 swingable about a rotation shaft 15*a* is provided at a terminal end portion of the pull chute 14. The holding plate 15 is normally urged toward the pull-supply path 14*a* by a compression spring 15*b* so as to hold the pull 3 between the holding plate 15 and the pull-supply path 14*a*. The structure and mechanism of the aforementioned components disposed in the slider-body-and-pull-supply section 10 have been well known, and therefore, they are not particular to the present invention.

Figure 3:
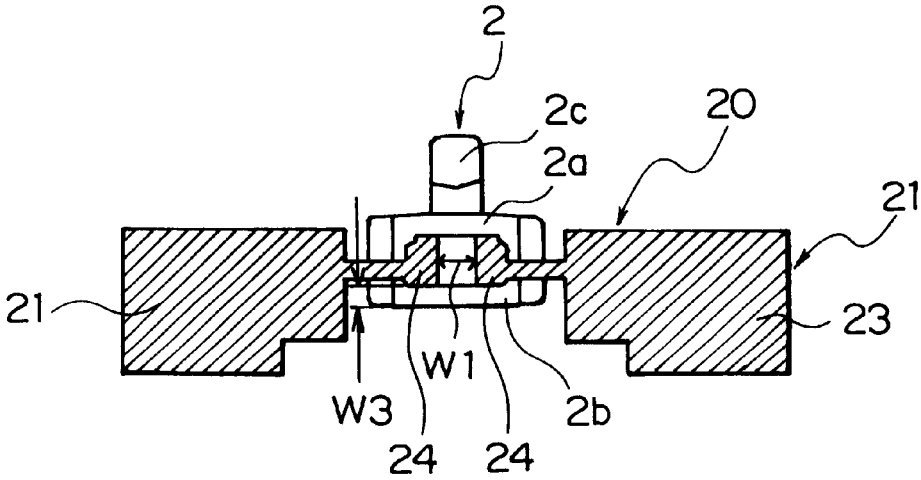
FIG. 3 is a transverse sectional view of the burr-removing section.

The burr-removing section 20 of the slider body 2 has a pair of lever-like members 21 symmetrical to each other, each of which has a section as shown in FIG. 3, and a slider-body-pushing lever 22 for pushing a slider body 2 fitting on the lever-like members 21. The lever-like member 21 is joined directly to the slider-transportation path 30*a* of the slider-transportation section 30 and has substantially the same section as a forming member 31 for forming the slider-transportation path 30*a* of the slider-transportation section 30 as shown in FIG. 5.

As for the structure thereof, the burr-removing section 20 comprises, as shown in both FIGS. 1 and 3, a pair of lever-like portions 23 each of which has a rectangular section in which an edge portion thereof extending in its longitudinal direction is cut out in a shape of a rectangular section, and a pair of protruded portions 24, each of which has a substantially lateral L shape with its cut out portion facing downward, extending from facing surfaces of the lever-like portions 23 horizontally in an approaching direction to each other. A gap W1 is formed between the mating protruded portions 24 of the right and left sides. Front end portions of the protruded portions 24 have the same sectional shape as that of a space formed between an upper wing 2*a* and a lower wing 2*b* of the slider 2. As shown in FIGS. 1 and 2, the slider-body-pushing lever 22 is formed of a plate material having such a thickness that enables it to enter into the gap W1 formed between the right and left protruded portions 24. The slider-body-pushing lever is actuated by an actuator 25 such as a cylinder.

When a slider body 2 supplied from the slider-body chute 12 reaches an entrance of the burr-removing section 20, the aforementioned actuator 25 is actuated so as to advance the slider-body-pushing lever 22 which is in a standby state at the back of the slider body 2, so that the slider body 2 is pushed from the back. As a result, the pair of the protruded portions 24, right and left, are passed through the space formed between the upper wing 2*a* and the lower wing 2*b*. Since the section of the pair of the protruded portions 24 is formed to be the same as an outlined sectional shape of the aforementioned space between the upper and lower wings 2*a*, 2*b*, burrs formed on or adhering to an inner face of the upper wing 2*a* and the lower wing 2*b* are scraped off during the passing of the protruded portions 24, thus trimming the inner face thereof. The scraped-off burrs are sucked and removed by a suction apparatus 26 disposed below the burr-removing section 20 through a suction pipe 26*a*. For this purpose, a bottom face of the burr-removing section 20 is open and a suction port 26*b* of the suction pipe 26*a* is open toward that open space.

The slider-transportation section 30 comprises a pair of transportation-path-forming members 31, a slider-body-transportation plate member 32 to be moved through vertical planes in the slider-transportation path 30*a* formed by the transportation-path-forming members 31 while drawing a rectangular trajectory, and an actuating mechanism 33 for actuating the slider-body-transportation plate member 32. The paired transportation-path-forming members 31 are formed of long lever-like materials having substantially the same shapes as the paired lever-like members 21 disposed at the burr-removing section 20 as described above. As shown in FIGS. 1 and 5, the transportation-path-forming members 31 are fixed on top faces of a pair of right and left supporting members 34 disposed and extending in the slider transportation direction on a table 4.

The supporting members 34 comprise a pair of right and left lever-like members as shown in FIG. 5 and have a pair of right and left slider-body-placing portions 34*a* protruded horizontally to face each other. A gap W2 sufficient for accommodating the slider-body-transportation plate member 32 is provided between the right and left slider-body-placing portions 34*a*. Further, a gap W3 is formed between a slider-body-placing surface 34*b* which is a top surface of each of the slider-body-placing portions 34*a*, and a bottom surface of each of substantially lateral L-shaped protruded portions 31*a* protruded horizontally in an approaching direction of the transportation-path-forming members 31. A dimension of the gap W3 is set to be substantially the same as a thickness of the lower wing 2*b* of the slider body 2.

Figure 4:
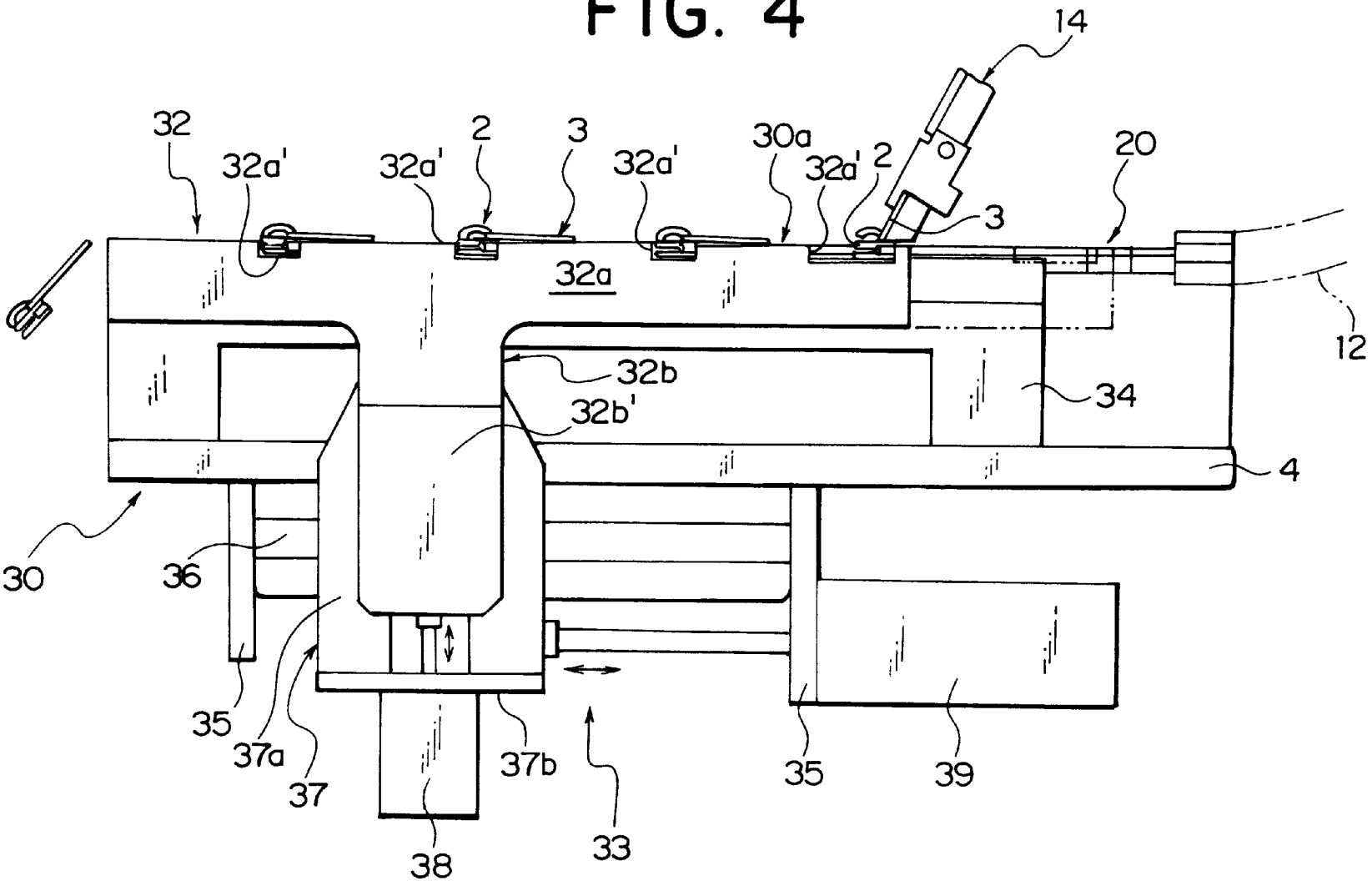
FIG. 4 is a schematic view showing an internal mechanism of a slider-transportation section.

The slider-body-transportation plate member 32 is composed of a substantially T-shaped plate material having a long slider-transportation guide 32*a* substantially as long as the slider-transportation path 30*a*, and a driving portion 32*b* extending perpendicularly downward from the slider-transportation guide 32*a* as shown in FIGS. 4 and 5. A thickness of the slider-transportation guide 32*a* is set to be slightly smaller than the gap W2 formed between the paired right and left slider-body-placing portions 34*a* so that the slider-transportation guide 32*a* can move freely within the gap W2. A plurality of slider-body-accommodating notch portions 32*a′* are formed at equal intervals as installing intervals of the respective aforementioned assembling sections along a top end of the slider-transportation guide 32*a*. Although an upper part of the driving portion 32*b* extending vertically downward from the slider-transportation guide 32*a* is formed with the same thickness as the slider-transportation guide 32*a*, its lower part down to its end is formed with a thicker portion 32*b′* so as to ensure a predetermined stiffness.

The slider-body-transportation plate member 32 is in a standby state at its lower limit position before a slider body 2 passes the burr-removing section 20. When the slider body 2 passes the burr-removing section 20, the slider-body-transportation plate member 32 is actuated by the actuating mechanism 33 as will be described later, so that it rises vertically from the lower limit position up to its upper limit position. Then, the slider body 2 is accommodated in the notch portion 32*a′*. At the lower limit position, a top end of the notch portion 32*a′* is located below a bottom of the lower wing 2*b* of the slider body 2 while the upper limit position is above the slider-body-placing surface 34*b* when it is raised to the maximum. Further, front and rear ends of the slider body 2 must face and contact with front and rear faces of the notch portion 32*a′*.

When the slider-body-transportation plate member 32 reaches its upper limit position, the slider-body-transportation plate member 32 is advanced by a pitch corresponding to that of the respective assembling sections that are disposed at equal pitches, so that the slider bodies 2 are carried to the respective assembling sections. After that, the slider-body-transportation plate member 32 starts descending, and at the same time, the respective assembling sections are operated so as to carry out the respective assembling works. During this operation, the slider-body-transportation plate member 32 is moved back by a pitch corresponding to the pitch of its last advancement, so that finally it is returned to the original lower limit position. This procedure is repeated. The slider that is finished with all the assembling works is discharged out of the slider-transportation path 30*a* by the final advancement. Next, the slider-body-transportation plate member 32 descends to the lower limit position in the advanced state and then moves back to the original lower limit position.

The actuating mechanism 33 of the slider-body-transportation plate member 32 is joined to the thicker portion 32*b′* of the driving portion 32*b* of the slider-body-transportation plate member 32. According to the embodiment shown here, a guide rail 36 parallel to the transportation direction is provided between a pair of front and back frames 35 extending vertically downward from a bottom face of the table 4 corresponding to the slider-transportation path 30*a* as shown in FIGS. 1 and 4. An L-shaped moving member 37 comprising a vertical plate portion 37*a* and a horizontal plate portion 37*b* is disposed on the guide rail 36 for supporting the slider-body-transportation plate member 32, such that it is guided slidably by the guide rail 36 for reciprocating in the transportation direction. A first cylinder 38 is fixed to the horizontal plate portion 37*b* of the moving member 37 such that a rod end of the first cylinder 38 is fixed to a center of a bottom face of the thicker portion 32*b'* of the slider-body-transportation plate member 32. Further, a rod end of a second cylinder 39 fixed to the frame 35 is fixed to a side face of the vertical plate portion 37*a* of the moving member 37.

The slider-body-transportation plate member 32 is actuated by the actuating mechanism 33 in a vertical plane parallel to the slider transportation direction, drawing a rectangular motion trajectory. That is, the rod of the first cylinder 38 extends so as to raise the slider-body-transportation plate member 32 standing by at the lower limit position up to the upper limit position, and then the rod of the second cylinder 39 extends so as to guide the slider-body-transportation plate member 32 along the guide rail 36 and advance it intermittently by the aforementioned pitch. A slider which is in contact with a front end of the slider-body-transportation plate member 32 and finished with assembling is pushed out of the unit. After that, the rod of the first cylinder 38 is contracted, and at the same time, the rod of the second cylinder 39 is also contracted, so that the slider-body-transportation plate member 32 is returned to the aforementioned lower limit position.

Figure 6:
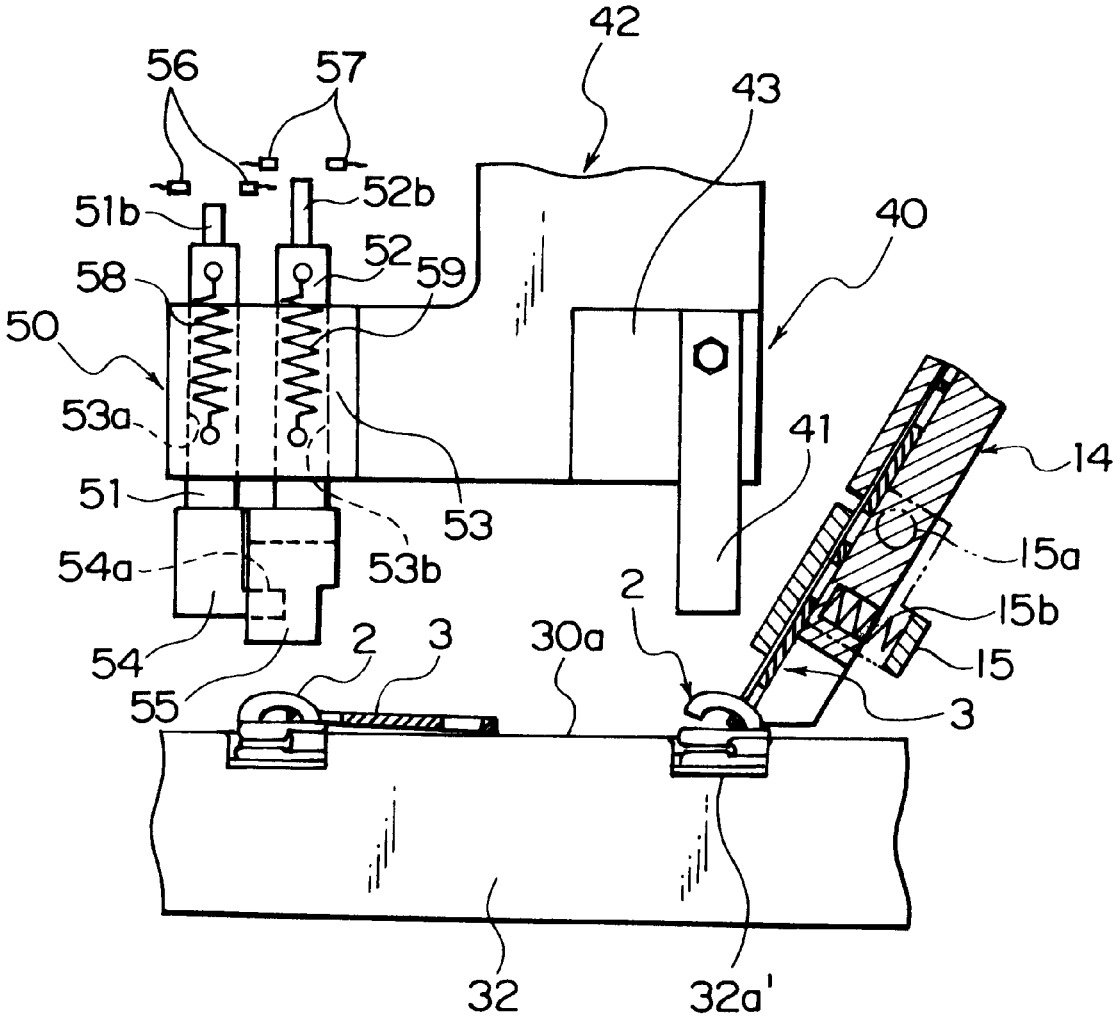
FIG. 6 is a side view showing a state of a crimping section and an inspecting section at the time of standby.
Figure 10:
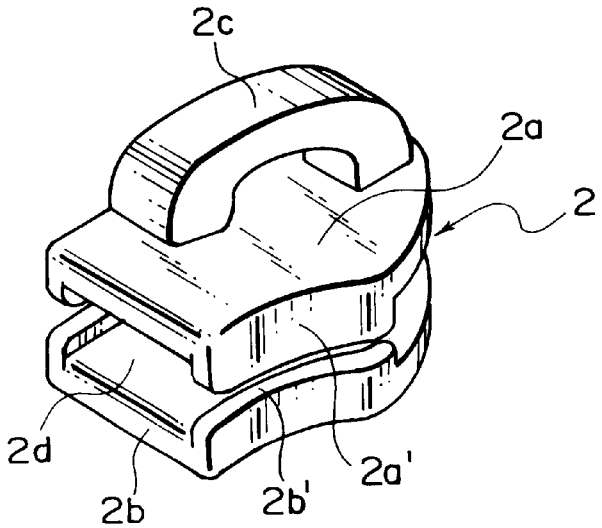
FIG. 10 is a perspective view showing an example of the slider body.

The pull-attachment-lug crimping section 40 for a slider body 2 is disposed at a position in front of and near the terminal end of the pull chute 14 as shown in FIG. 6. The pull chute 14 is disposed in the rear part of the unit extending obliquely from above to the pull-attachment-lug crimping section 40. At that time, a subsequent pull 3 to be assembled at the terminal end is disposed such that its annular connecting portion 3*a* is exposed outside as described above. The slider body 2, which is on the other hand transported along the slider-transportation path 30*a* as described above, is comprised of, as shown in FIG. 10, an upper wing 2*a,* a lower wing 2*b,* a supporting post portion (not shown) connecting end portions of the respective wings 2*a* and 2*b*, and a pull-attachment lug 2*c* curved in a substantially U shape. Thus pull-attachment lug 2*c* has one end fixed to a top face of an end portion of the supporting post portion side of the upper wing 2*a* and the other end open such that it is floated up from the top face of the upper wing 2*a*. Flanges 2*a'* and 2*b'* extend on the peripheries of the upper wing 2*a* and lower wing 2*b* except for an element guide 2*d* so as to face each other.

The pull-attachment-lug crimping section 40 disposed in front of and near the terminal end of the pull chute 14 comprises, as shown in FIGS. 1 and 6, a punch 41 and a lift 42 for lifting the same punch 41. The lift 42 lifts up and down by an actuator 44 such as a cylinder. The punch 41 is fixed integrally to a first block 43 fixed to the lift 42 by bolts or the like. This lift 42 is also used as a lift for a slider-body sensor 54 and a pull sensor 55 of a slider-inspecting section 50 which will be described later. A lowered position of the punch 41 is a stop position for the slider body 2 transported along the slider-transportation path 30*a* and having a pull-attachment lug 2*c* inserted into a hole 3*b* of an annular connecting portion 3*a* of a pull 3 stopped at the terminal end of the pull chute 14. It is also a position where a top of the pull-attachment lug is to be pressed. Therefore, when the pull-attachment lug 2*c* is crimped by the punch 41 of the unit of the present invention, the pull 2 where the pull-attachment lug 2*c* is inserted into the hole 3*c* of the annular connecting portion 3*a* is supported by the pull chute 14, so that the pull 2 is supported stably before it is released from the pull chute 14.

The slider-inspecting section 50 comprises first and second sliding levers 51 and 52 lifting up and down slidably through first and second through-holes 53*a* and 53*b* respectively formed in a second block 53 fixed to part of the lift 42 as shown in FIG. 6, a slider-body sensor 54 and a pull sensor 55 each fixed to a bottom end of each of the sliding levers 51 and 52, and first and second photoelectric tubes 56 and 57 disposed above and near top ends of the respective sliding levers 51 and 52.

Figure 8:
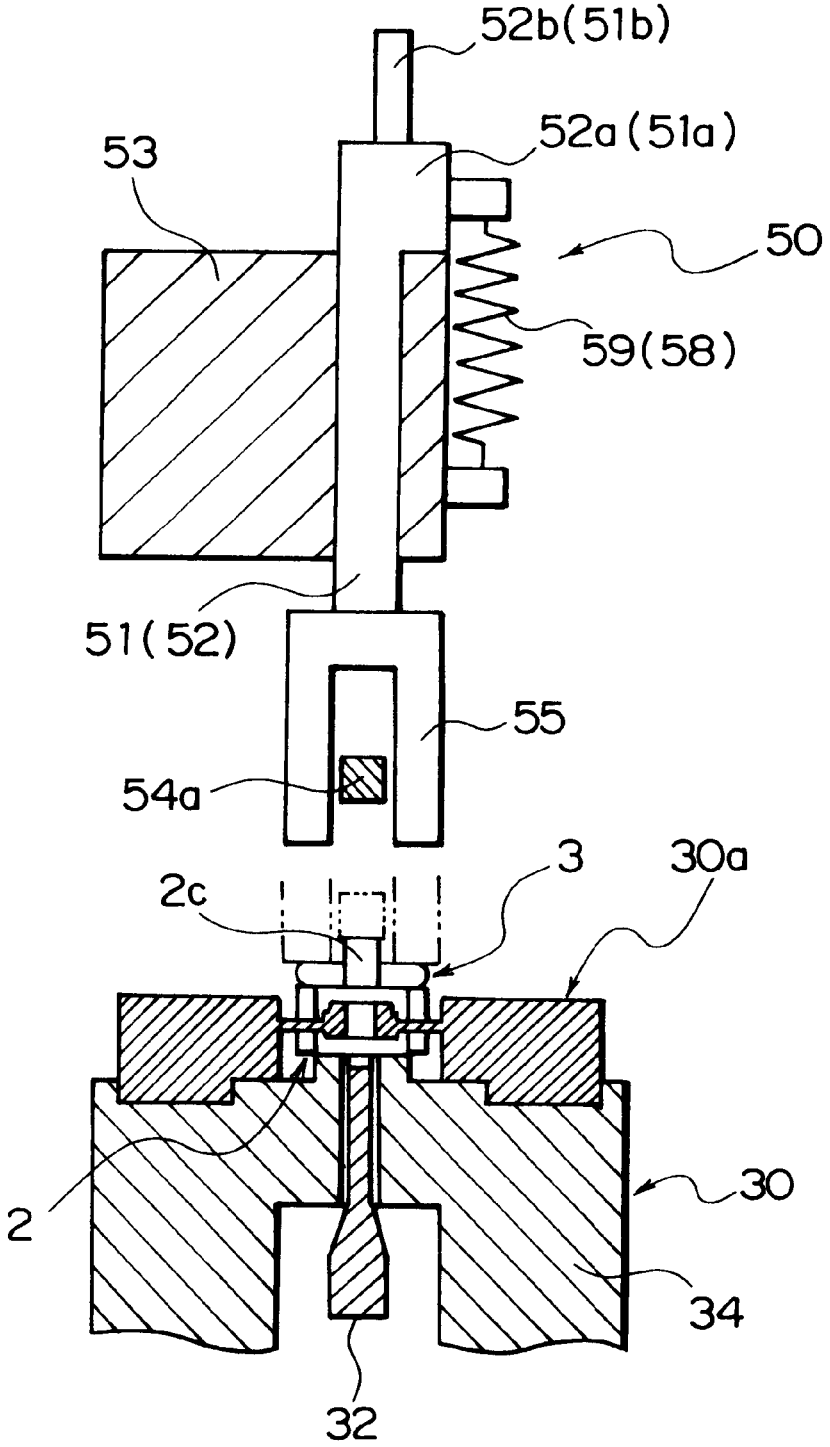
FIG. 8 is an explanatory view of an inspection mechanism at the time of inspection on a slider body and a pull by the inspecting section.
Figure 9:
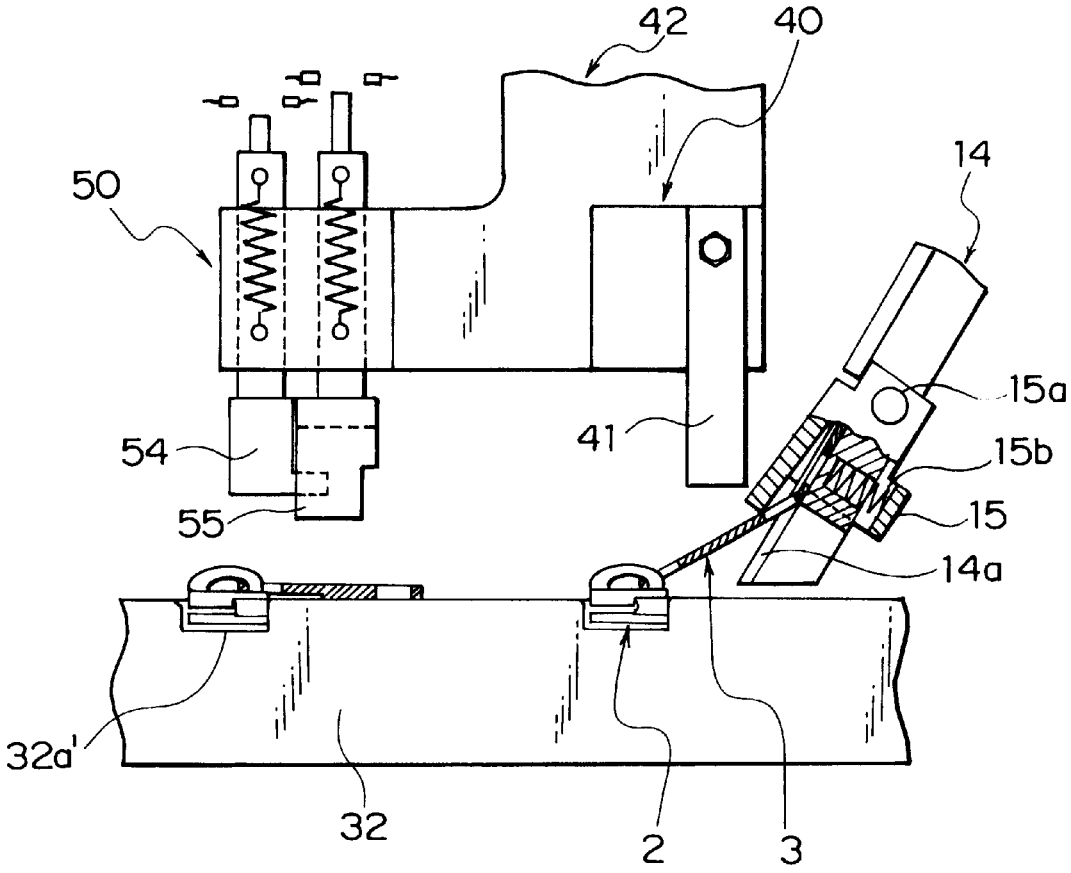
FIG. 9 is a side view showing a slider transporting state after crimping and inspection are completed.

The respective sliding levers 51 and 52 are provided with jaw portions 51*a* and 52*a* which are protruded so as to form step portions and contact a top face of the second block 53 as shown in FIG. 8 so that they are prevented from descending further. Projection pins 51*b* and 52*b* are provided to project from top ends of the respective sliding levers 51 and 52. The first and second photoelectric tubes 56 and 57 are fixed to the lift 42 and located such that a top end of each of the projection pins 51*b* and 52*b* passes the photoelectric tubes 56 and 57 when the respective projection pins 51*b* and 52*b* are lifted up/down. On the other hand, first and second tension springs 58, 59 are provided between the respective sliding levers 51 and 52 and the second block 53, so that the sliding levers 51 and 52 are always urged downward, and the jaw portions 51*a* and 52*a* keep contact with the top face of the second block 53. Therefore, the respective sliding levers 51 and 52 do not descend further.

The first sliding lever 51 is a member for inspecting whether or not the pull-attachment lug 2*c* of the slider body 2 is crimped accurately. A slider-body sensor 54 is provided at a lower end thereof. The slider-body sensor 54 is composed of a rectangular piece body shown in FIG. 6, which has a sensing portion 54*a* projected horizontally backward at a rear face of its lower end. On the other hand, the second sliding lever 52 is a member for inspecting whether or not the pull 3 is assembled accurately on the slider body 2. The pull sensor 55 having a configuration as shown in FIG. 8 is provided at a bottom end of the sliding lever 52. This pull sensor 55 is composed of a forked piece body which rides over the pull-attachment lug 2*a* of the slider body 2 so as to contact with right and left end portions of a top face of a pull 3 laid down. Then, the sensing portion 54*a* of the slider-body sensor 54 is set to have such a width that it may be inserted in between the two forked legs of the pull sensor 55.

The slider-discharge section 60 is comprised of a slider-discharge chute 61 provided at a terminal end of the slider-transportation path 30*a* and an accommodating box 52 disposed below the slider-discharge chute 61 as indicated by phantom lines of FIG. 1. The slider-discharge chute 61 discharges a slider 1 in which assembling of the pull 3 on its slider body 2 is completed, out of the unit in succession. At the time of this discharge, the slider body 2 is not accommodated in the notch portion 32*a'* of the slider-body-transportation plate member 32 but the slider body 2 is just kept in contact with a front end of the slider-body-transportation plate member 32. Then, the slider body 1 is pushed out of the slider-transportation path 30*a* with a progress of the slider-body-transportation plate member 32.

A process for assembling a pull 3 onto a slider body 2 by means of the slider-pull-assembling unit of this embodiment having such a structure will now be described. First, as shown in FIGS. 1 and 2, the slider body 2 supplied from the slider-body chute 12 intermittently reaches an entrance of the burr-removing section 20 and stands by there. Here, a well known mechanism is employed to feed the slider bodies 2 intermittently.

Next, the cylinder 25 placed behind the burr-removing section 20 is actuated, so that the slider-body-pushing lever 22 is advanced toward a connecting post portion (not shown) connecting the upper wing 2*a* and the lower wing 2*b* of the slider body 2 standing by at the entrance of the burr-removing section 20 from behind. Then, the slider body 2 is pushed forward along the right and left lever-like members 21 such that the protruded portions 24 protruded horizontally from the right and left lever-like members 21 of the burr-removing section 20, having the same sectional shape as that of the space formed between the upper wing 2*a* and the lower wing 2*b*, are inserted in the space. While the slider body 2 is being moved, burrs or the like formed internally upon molding are scraped off by the protruded portions 24 to be trimmed. On the other hand, the scraped-off burrs are sucked by the suction apparatus 26 provided below the burr-removing section 20 through the suction pipe 26*a* and discharged.

The slider-body-pushing lever 22 is further advanced, and after passing the burr-removing section 20, the slider body 2 is transferred positively to the slider-transportation-path-forming members 31 having substantially the same section as that of the lever-like members 21 and connected to the lever-like members 21. When this transfer is completed, the slider-body-pushing lever 22 starts retreating, and at the same time, the first cylinder 38 of the slider-transportation section 30 is actuated in its extending direction so as to raise the slider-body-transportation plate member 32 standing by below the slider-transportation section 30. Said raised position is as indicated by phantom lines of FIG. 4. The slider body 2 is accommodated in the notch portion 32*a* ' formed in the slider-body-transportation plate member 32.

Next, the second cylinder 39 is moved in its extending direction only by a pitch between the adjacent assembling sections. The slider bodies 2 located in the respective assembling sections are carried all at once to the next assembling sections by this moving. After this transportation is completed, the assembling processes at the respective assembling sections are carried out. According to this embodiment, the processes to be carried out include a process for inserting a pull-attachment lug 2*c* of a slider body 2 into a hole 3*b* of an annular connecting portion 3*a* of a pull 3, a process for crimping the pull-attachment lug 2*c* by the punch 41, a process for inspecting whether or not crimping of the slider and connecting of the pull have been achieved accurately in the slider after the crimping work is completed.

Figure 7:
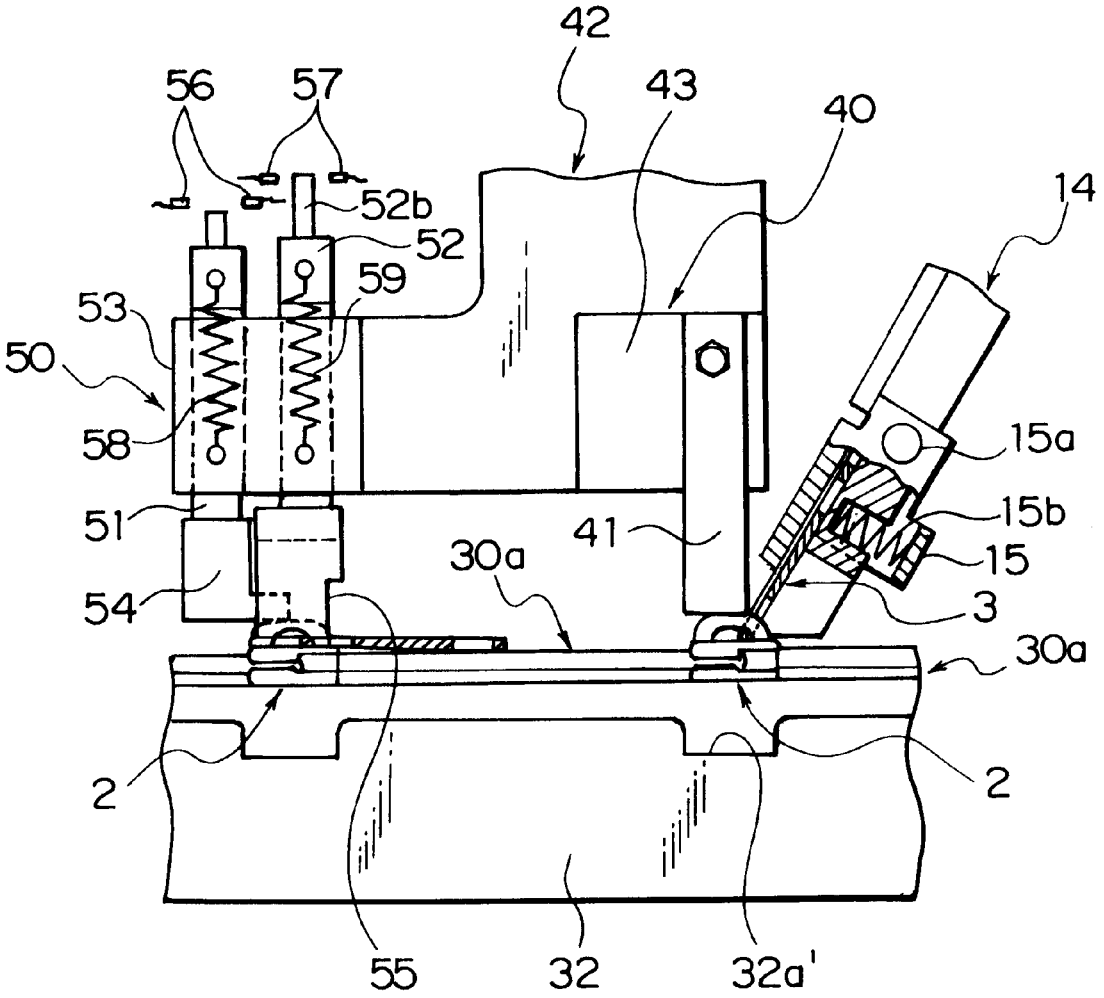
FIG. 7 is a side view showing an operating state of the crimping section and the inspecting section at the time of crimping and inspection.

Before the slider body 2 is transported away, the pull 3 is supplied from the pull chute 14 in a state as indicated by FIG. 5. That is, a bottom end portion of the annular connecting portion 3*a* of the pull 3 is projected downward from a bottom end of the chute 14 and the hole 3*b* of the annular connecting portion 3*a* is positioned within the inverted U-shaped notch portion 14*b* at the bottom end of the chute, while being held by the pawl portions 14*c* at the bottom end of the chute 14. A subsequent slider body 2 is carried to the pull 3 under such a state and then an open end of the pull-attachment lug 2*c* of the slider body 2 is inserted into the hole 3*b* of the pull 3. When the insertion of the pull-attachment lug 2*c* is completed, transportation of the slider body 2 is stopped. Therefore, at the time of this stop, the pull 2 is still held at the bottom end of the pull chute 14 so that its free motion is restricted as shown in FIG. 6. In this state, the lift 42 descends so that the pull-attachment lug 2*c* is crimped by the punch 4. As a result, the open end between the pull-attachment lug 2*c* and a top face of the upper wing 2*a* is closed as shown in FIG. 7.

On the other hand, the preceding slider body 2 by the aforementioned transportation has already reached the slider-inspecting section 50. Here, when the lift 42 descends with the first photoelectric tube 56 and the second photoelectric tube 57 as described above, the second block 53 also descends with the first and second sliding levers 51 and 52 via the first and second tension springs 58 and 59. When the slider body 2 and the pull 3 are assembled accurately, the bottom ends of the sensor 54*a* of the slider-body sensor 54 and the pull sensor 55, attached to respective bottom ends of the first and second sliding levers 51 and 52, come into contact with a top face of the pull-attachment lug 2*c* and a top face of the pull 3 laid down. After this contact, the lift 42 continues to descend so that the jaw portions 51*a* and 52*a* of the respective sliding levers 51 and 52 leave the top face of the first block 53. That is, it means that the first and second projection pins 51*b* and 52*b* projecting from the top ends of the respective sliding levers 51 and 52 increase their projection amounts upward relative to the second block 53.

According to this embodiment, when the pull-attachment lug 2*c* of the slider body 2 is crimped properly so that its open end is closed, the first projection pin 51*b* is placed at a position where it does not intersect the first photoelectric tube 56. Thus, when the pull-attachment lug 2*c* of the slider body 2 is crimped properly, even if the second block 53 descends to its lower limit position, the first projection pin 51*b* does not intersect the first photoelectric tube 56. However, when the pull-attachment lug 2*c* is not crimped properly so that its open end is still open, the top face of the pull-attachment lug 2*c* is higher than being in a proper state. Therefore, even when the sensing portion 54*a* of the slider-body sensor 54 comes into contact with the top face of the pull-attachment lug 2*c*, the second block 53 continues to further descend, so that the projection amount of the first projection pin 51*b* relative to the second block 53 is increased more than the proper state. As a result, the first projection pin 51*b* intersects the first photoelectric tube 56 and then, a signal indicating that matter is transmitted to a control section (not shown).

On the other hand, when the pull 3 is assembled on the pull-attachment lug 2*c* properly, the second projection pin 52*b* on the second block 53 is provided at a position such that it intersects the second photoelectric tube 57. Therefore, in the case where the pull 3 is assembled on the pull-attachment lug 2*c* properly, when the second block 53 descends to a position to contact the pull 3, the second projection pin 52*b* intersects the second photoelectric tube 57. However, unless the pull is installed properly, the pull sensor 55 descends further without contacting the pull 3, at which time the second projection pin 52*b* has not yet intersected the second photoelectric tube 57. Then, a signal notifying this matter is transmitted to the control section (not shown).

When the respective slider bodies 2 are carried to the process for crimping the pull-attachment lug 2*c* and the process for inspecting the slider body 2 and pull 3, the slider body 2 which keeps contact with a front end of the slider-body-transportation plate member 32 and on which the pull 3 is assembled drops into an accommodation box 62 disposed below through the discharge chute 61 provided at the forefront portion of the slider-transportation path 30*a,* halfway of that transportation.

When the slider-body-transportation plate member 32 is actuated forward by an amount corresponding to a single pitch, the first cylinder 38 is actuated in its contraction direction so as to lower the slider-body-transportation plate member 32 to a waiting position below. After that, the second cylinder 39 is also actuated in its contraction direction so as to move back the slider-body-transportation plate member 32, so that the notch portion 32*a* ′ formed at the rearmost end is moved to a standby position below the entrance of the burr-removing section 20.

That is, according to this embodiment, each time when the slider-body-transportation plate member 32 is reciprocated by a single pitch repeatedly along the rectangular trajectory, assembling works at plural assembling processes are carried out at the same time and further, the slider body in which the assembly is completed is discharged out of the unit. Therefore, the pull assembling work can be accelerated. Further, the assembling of the pull 3 onto the slider body 2 and crimping of the pull-attachment lug, which are conventionally considered to be difficult to carry out at a high speed, can be achieved accurately and smoothly.

What is claimed is:

1. A slider-pull-assembling unit having plural assembling sections for automatically assembling a pull onto a slider body of a slider for opening/closing a slide fastener, comprising:

a slider-transportation path for transporting said slider bodies to said plural assembling sections in succession;

a slider-body-supply path connected to said slider-transportation path;

a pull-supply path disposed halfway of said slider-transportation path for supplying said pull to said slider-transportation path; and a slider transporting means for transporting said slider body along said slider-transportation path intermittently, wherein said slider transporting means includes a slider-body-transportation plate member having rectangular notch portions spaced at intervals of said plural assembling sections along a top end edge thereof, each for accommodating said slider body, said slider-body-transportation plate member being adapted to be actuated in said slider-transportation path so as to draw a rectangular trajectory in a vertical plane, and an actuation upper limit position of a top end of said rectangular notch portion is set to be above a slider-body-placing surface of said slider-transportation path and an actuation lower limit position of the top end of said notch portion is set to be at a retreat position below said slider-body-placing surface.

2. A slider-pull-assembling unit according to claim 1, wherein said pull-supply path is disposed obliquely at a predetermined angle with respect to said slider-transportation path, extending from above a rear portion thereof, and a crimping section for a pull-attachment lug of the slider body is disposed in front of and near a confluent position of said pull-supply path and said slider-transportation path.

* * * * *